United States Patent [19]

Bach

[11] Patent Number: 4,873,142

[45] Date of Patent: Oct. 10, 1989

[54] ACRYLIC FIBERS HAVING SUPERIOR ABRASION/FATIGUE RESISTANCE

[75] Inventor: Hartwig C. Bach, Pensacola, Fla.

[73] Assignee: Monsanto Company, Del.

[21] Appl. No.: 104,555

[22] Filed: Sep. 30, 1987

Related U.S. Application Data

[63] Continuation of Ser. No. 847,991, Apr. 3, 1986, abandoned.

[51] Int. Cl.[4] ..... D02G 3/00

[52] U.S. Cl. ..... 428/359; 428/364; 428/373; 428/401

[58] Field of Search ..... 428/373, 392, 394, 364, 428/397, 359, 401

[56] References Cited

U.S. PATENT DOCUMENTS

| | | | |
|---|---|---|---|
| 2,957,748 | 10/1960 | Lieseberg | 264/206 |
| 3,193,603 | 7/1965 | Rowe et al. | 264/182 |
| 3,350,872 | 11/1967 | Gorrafa | 428/373 |
| 3,624,195 | 11/1971 | Nakayama et al. | 428/373 |
| 3,644,609 | 2/1972 | Nakagawa et al. | 428/373 |
| 3,701,819 | 10/1972 | Yoshida et al. | 428/373 |
| 3,932,577 | 6/1976 | Palethorpe et al. | 264/182 |
| 4,067,948 | 1/1978 | Reinehr et al. | 264/182 |
| 4,075,075 | 2/1978 | Sakurada et al. | 522/74 |
| 4,293,613 | 10/1981 | Bach et al. | 428/373 |
| 4,297,412 | 10/1981 | Achard et al. | 428/373 |
| 4,332,762 | 6/1982 | Lynch | 428/373 |

FOREIGN PATENT DOCUMENTS

| | | | |
|---|---|---|---|
| 756012 | 4/1967 | Canada | 18/147 |
| 758931 | 5/1967 | Canada | 18/147 |
| 0181998 | 6/1986 | European Pat. Off. . | |
| 78624 | 9/1970 | German Democratic Rep. . | |
| 29454 | 7/1972 | Japan . | |

OTHER PUBLICATIONS

V. Grove and G. Mann–Faserforschung and Textiltechnik, 19, No. 2, pp. 49–55, 1968.

*Primary Examiner*—Lorraine T. Kendell
*Attorney, Agent, or Firm*—John W. Whisler

[57] ABSTRACT

Acrylic fibers are provided having superior abrasion resistance and flex fatigue properties as well as other properties desirable for end use applications in fabrics where wear performance properties are important, such as socks. The fibers may be made by a wet spinning process in which the spinbath consists of dimethylformamide and water where the concentration of the dimethylformamide is in the range of 72 to 84% by weight.

4 Claims, No Drawings

ACRYLIC FIBERS HAVING SUPERIOR ABRASION/FATIGUE RESISTANCE

This is a continuation of application Ser. No. 847,991, filed Apr. 3, 1986, now abandoned.

BACKGROUND OF THE INVENTION

1. Field of the Invention

This invention relates to acrylic fibers having superior abrasion resistance and flex fatigue properties. The term "acrylic fiber", when used herein, means a fiber in which the fiber-forming substance is any long chain synthetic polymer composed of at least 35% by weight of acrylonitrile units $$(-CH_2-\underset{\underset{CN}{|}}{CH}-).$$

The term "fiber" includes fibers of extreme or indefinite length (filaments) and fibers of short length (staple). The term "yarn", as used herein, means a strand of fibers and the term "tow" means a larger strand of fibers without definite twist collected in loose rope-like form, usually held together by crimp. Tow is the form which most fiber reaches before being converted (e.g. cut) into staple.

2. Description of the Prior Art

Acrylic fibers have the appearance and feel of wool and therefore, are widely used in socks where wool-like appearance and feel are important. Unfortunately, commercially available acrylic fibers lack the level of flex fatigue and abrasion resistance properties that is required to provide socks having truly significant wear performance properties, for example, socks knitted from commercially available acrylic fibers tend to abrade (develop holes) in the toe and heel regions thereof within a relatively short period of time. This deficiency of acrylic fibers has been long recognized and much effort has been expended on the part of acrylic fiber producers to improve the flex fatigue and abrasion resistance properties of acrylic fibers. One approach that has been taken to correct this deficiency is described in U.S. Pat. No. 3,932,577. This approach relates to the wet spinning of acrylic fibers and consists of adding a small amount of water (1 to 8%) to the spinning solutions used to prepare the fibers. Although this approach provides some improvement in abrasion resistance, there is still room for further improvement.

Accordingly, it is the primary object of the present invention to provide acrylic fibers from which socks having excellent wear performance properties can be made.

SUMMARY OF THE INVENTION

In accordance with the present invention, acrylic fibers are provided that have superior abrasion resistance and flex fatigue properties. The fibers also have other desirable properties which in combination with their superior abrasion resistance and flex fatigue properties make the fibers particularly suitable and useful for commercial applications in fabrics where wear performance properties are important, such as socks, upholstery, and the like. The fibers are characterized in having a mercury density of greater than 1.0 gm/cc and an average flex fatigue parameter value (hereinafter defined) of at least −0.60 and, preferably, at least −0.40 and, more preferably, at least −0.30 and, most preferably, at least −0.11. Preferably, the fibers also have a tenacity of at least 1.75 gpd and an average knot strength of at least 85% of the tenacity.

Acrylic fibers having a mercury density (measured at atmospheric pressure) of 1.0 gm/cc or less inherently have voids which yield generally undesirable properties, such as lack of luster and dye information.

The fibers of this invention are particularly useful for sock and home furnishing end use applications where abrasion resistance and flex fatigue properties are important. Conventionally, acrylic fibers in yarn or tow form are converted into staple length fibers which in turn are converted into staple yarn for end use applications.

Flex fatigue parameter values are determined by the Satec Test (hereinafter described in detail) using a Satec Tester machine made by the Satec Corporation, Grove City, Pa. Briefly, in conducting the test, a single fiber is pulled back and forth over a sharp blade until the fiber breaks (fails). One back and forth movement is a cycle. The cycles to fail (CTF) value is recorded along with the denier (d) value of the fiber and the aspect ratio (AR) value of the cross-section of the fiber. A plurality of fibers selected at random from a sample of fibers are tested. (CTF), (d) and (AR) values obtained from the testing are averaged and the averaged values used to determine the flex fatigue parameter (FFP) by solving the following formula:

$$FFP = \ln (CTF) - 7(AR^{0.73})/dpf)^{0.5}.$$

The average flex fatigue parameter value is obtained by determining the FFP value for a plurality of samples selected at random.

The aspect ratio is the ratio of the width of the fiber cross-section (x-axis) to the height of the fiber cross-section (y-axis) with the measurements being made where the width and the height are maximum values.

PREFERRED EMBODIMENTS OF THE INVENTION

The acrylic fibers of this invention may be prepared by a wet-spinning process comprising:

(1) extruding a solution (dope) of an acrylic polymer in dimethylformamide (DMF) through a spinnerette nozzle immersed in an aqueous DMF coagulation bath (i.e. spinbath) maintained at temperatures between 10° and 90° C. and containing DMF at a concentration ranging from 72 to 84%, by weight, to form uncollapsed tow (2) withdrawing the uncollapsed tow from the bath (3) washing the tow with water to remove DMF (4) stretching the washed tow in boiling water (or equivalent treatment) an amount sufficient to impart significant molecular orientation to the filaments of the tow and (5) drying the stretched tow at a temperature which is sufficiently high to provide a tow consisting of filaments having a mercury density of greater than 1.0 gram/cc.

The conditions under which the process is conducted are correlated to provide fibers having an average flex fatigue parameter value of at least −0.6, a tenacity of at least 1.75 gpd and a knot strength corresponding to at least 85% of its tenacity.

Preferably, the spinbath is maintained at a temperature ranging from about 25° to 40 C. When the temperature is reduced from about 25° C. or increased above about 40° C., the average flex fatigue parameter value of the resulting fibers tend to fall off. Also, at low temperatures the spinning of the dope into filament becomes a problem. It is essential that the concentration of DMF in the spinbath be in the range of from 72% to 84%, by weight. At DMF concentrations below about 72%, the FFP values are low and fibers tend to break in the spinbath and at concentrations above about 84%, the fibers tend to fuse to one another in the spinbath. Filaments that are fused to one another ("married") snag on equipment during conversion of the fibers into staple, the processing of the staple into yarns and the knitting of such yarns into socks and other fabric.

According to a preferred embodiment of the invention the filaments are dried by passing the tow under tension with a plurality of wraps over two or more heated rolls, the rolls being heated internally with steam to a surface temperature of about 150° C. The filaments in passing over the rolls change from an opaque (dull), uncollapsed filaments having a mercury density of less than 1.0 gm/cc to lusterous collapsed filaments having a mercury density greater than one and typically greater than 1.15 gm/cc. The uncollapsed filaments have pockets (voids in the polymer structure) filled with water or water and DMF. As the tow passes over the rolls, it becomes heated, water in the form of vapor is forced from the filaments and the filaments assume a collapsed structure. The collapsed filaments have a greater density than the uncollapsed filaments. Uncollapsed filaments lack dye uniformity due to voids and are more difficult to process, also due to the voids, than are the collapsed filaments. The dried collapsed filaments in tow form are then crimped, for example, by first passing the tow into contact with steam to preheat the tow and then passing the tow through a conventional stuffer box crimper using pressurized steam as the jetting fluid. The crimped tow is them piddled into a can. The tow then is preferably annealed by heating the tow in saturated steam at a temperature within 25° C. of its wet melt point while the tow is in a relaxed state, for example, by placing the can of tow in an autoclave and then subjecting the tow to repeated cycles where each cycle consists of pressurizing the autoclave with steam then venting the autoclave to reduce the pressure to atmospheric pressure. The temperature and pressure of the steam is controlled to achieve a desired amount of shrinkage of the tow (e.g. 30%). Annealing of the tow, increases the elongation of the filaments from 12–15% to over 30% (e.g. 40%) and renders the filaments less brittle. Annealing also somewhat reduces the tenacity of the filaments from, for example, 3 gpd to 2.2 gpd.

According to another embodiment of the invention, the tow after being stretched in boiling water is presteamed, crimped in a stuffer box and then dried, for example on a moving belt using superheated steam. Optionally, the tow is dyed inline, neutralized and washed after being stretched in boiling water and prior to being presteamed.

Preferably, the acrylic fibers of the present invention are composed of a fiber-forming copolymer formed by reacting acrylonitrile with one or more vinyl monomers copolymerizable therewith. Such vinyl monomers are well-known in the art and include by way of example vinyl acetate, vinylpyridine, methylvinylpyridine, vinyl chloride, vinylidene chloride, methacrylate, methyl methacrylate, vinyl bromide, styrene and sodium sulphophenyl methallyl ether. Preferably, the copolymer is composed from 85% to 98% by weight of acrylonitrile units (i.e.

$$CH_2-\underset{\underset{CN}{|}}{CH}- \text{ units).}$$

Preferably, the processing conditions and acrylic polymers are selected to provide fibers having an average flex fatigue parameter value of at least −0.40 and, more preferably, −0.30, and most preferably, at least −0.11, tenacities of at least 2.0 gpd (e.g. in the 2.0 to 3.0 gpd range), knot strengths of at least 90% of their tenacities, a dye diffusion rate greater than 0.3 $cm^2$/sec., and an elongation of at least about 25% and, preferably, in the range of 35% to 60%. (Elongation values given herein are elongation at break values.) Fibers of this invention prepared by the above wet-spinning process contain from 0.001 to 1.0% by weight of DMF.

Fibers of this invention may be of any desired cross-section. For sock end use applications, the fibers will usually have a denier ranging from 1.5 to 4.0 and typically ranging from 2.0 to 3.0.

Tows wet-spun in accordance with the above process are characterized in having substantially no married fibers.

SATEC TEST

Flex fatigue parameter values and average flex fatigue parameter values are determined using a Satec Flex Tester machine.

The machine has ten test stations. A single fiber (referred to as a "fiber specimen") is tested at each of the ten stations. A blade bar holds ten individual blades in a vertical position with the sharp edge of the blades pointed upwardly. Each edge is perpendicular to a post on a reciprocating arm of the tester. In testing a fiber specimen, one end of the fiber is attached by means of a tab to the post and the other end is attached by means of a second tab to a test weight selected in accordance with the denier of the fiber specimen. The fiber specimen extends horizontally from the tab attached to the post over the blade edge associated therewith and then vertically down the back of the blade edge to the tab to which the weight is attached. During testing, the reciprocal arm moves back and forth approximately 2 cm. One cycle consists of one back and forth movement. A counter is associated with each station. When a fiber specimen fails (breaks) the test weight is caught in a split copper cup and completes a circuit to shut off the counter associated with that station.

The fiber specimens are prepared as follows:

(1) Twenty single fibers are selected at random from a fiber sample and the denier of an 18 cm length of each of the fibers is determined.

(2) The fifteen fibers with deniers most nearly that of the average of the twenty fibers are selected for testing.

(3) The denier (d) and aspect ratio (AR) of each of the fifteen sample specimens are recorded.

(4) Sixty plastic tabs are laid out on a lay-up board with four tabs in line spaced at least 3 cm apart for each fiber.

(5) The fibers are laid over the tabs and glued to the tabs by dropping a small drop of glue on to each fiber where it contacts a tab. There is a hole in each tab for either attaching the tab to the post on the reciprocating arm or hanging test weights.

(6) Each fiber is cut in two between the two middle tabs to form two fiber specimens from each fiber. Fiber specimens are loaded for testing by hooking the appropriate weight through the hole of the bottom tab and lifting the top tab up with tweezers, resting the specimen against the knife blade and gently slipping the hole of the top tab down over the post on the reciprocating arm. Once all positions to be used are loaded the counters are set to zero and the tester started and continued until all fiber specimens fail. The cycles-to-fail (CTF) is recorded for each fiber specimen. The test is repeated until all thirty fiber specimens have been tested. The (CTF) values, dpf and aspect ratios of the thirty fiber specimens are averaged.

Either of two blades may be used in conducting the test. A different set of weights is used with each blade. The specification for the blades and weights are as follows:

| Blade | Radius of Curvature | Test Weight |
|---|---|---|
| No. 1 | 0.0005 inches (0.00127 cm) | 0.50 gpd |
| No. 2 | 0.00028 inches (0.00071 cm) | 0.35 gpd |

Blade No. 1 was made by Satec Corporation and Blade No. 2 was made by Valenite Corporation, 3100 Stephenson Highway, Madison Heights, Mich. 48071, under the designation Grade VC2, No. BJ, Style SPC 322. These blades or equivalent blades may be used in conducting the test. The radius of curvature given above for each type of blade represents the average of the radius of curvatures of the ten blades on the machine during testing. If the average radius of curvature is different from that specified above, one or more of the blades must be replaced with different blades so as to attain the specified average.

If the test is conducted using Blade No. 1, the averaged (CTF) value for the thirty fiber specimens is multipled by 1.8398 before calculation of the flex fatigue parameter (FFP). The flex fatigue parameter is then calculated for the fiber sample using the averaged (CTF), dpf and aspect ratios values in the following formula:

$$FFP = \ln(CTF) - 7(AR^{0.73}/dpf)^{0.5}.$$

The average flex fatigue parameter value is the average of the flex fatigue parameter values of fifteen fiber samples, each determined as described above, where the fifteen fiber samples are selected at random.

All flex fatigue parameter values and average flex fatigue parameter values given herein have reference to and/or are determined using the above procedures.

The above formula defines a straight line having a y-axis intercept when x is zero corresponding to FFP, where in the formula y is "ln (CTF)" and x is $7(AR^{0.73}/dpf)^{0.5}$. The greater the FFP value, the greater the flex fatigue/abrasion resistance properties are of the fiber.

The following examples are given to further illustrate the invention. In the examples percentages are weight percentages except in those instances where the shrinkage or elongation of a fiber is given. In those instances, percentages represent changes in the length of the fibers.

EXAMPLE 1

This example illustrates the preparation of acrylic fibers of the present invention and also the effect of varying the spinbath temperature on the tensile properties and flex fatigue parameter values of such fibers.

A spinning dope (25% polymer) was prepared by dissolving a 50/50 mixture of 2500 g of an acrylic polymer (I) containing 92.5% acrylonitrile (AN) and 7.5% vinyl acetate (VA) and 2500 g of an acrylic polymer (II) containing 92.1% AN and 7.3% VA and 0.6% of sodium sulfophenyl methallyl ether (SPME) in 15,000 g of dimethyl formamide (DMF). For spinning, a 1000 hole spinneret was used; the spinneret had elliptical spinneret capillaries (2/1 ellipse) with a cross-sectional area corresponding to that occupied by a round capillary with a 3.109 mil (0.079 mm) diameter. The dope was extruded through this spinneret at a 100° C. dope temperature into a spinbath containing a DMF/water mixture of 78% DMF at a temperature ranging from 25° to 40° C. The resulting fiber bundle was withdrawn from the spinbath at a linear speed of 20 fpm (6.1 mpm) with a theoretical jet stretch of 0.9× by a first set of rolls, washed on these rolls, then stretched 6× in boiling water (cascade stretch) between the first and second set of rolls, washed thoroughly on the second set of rolls, then dried after application of finish on a set of drying rolls heated to 150° C. The fiber bundle was wound up on a winder bobbin at a spinning speed of 120 fpm (36.6 mpm). The fiber bundle was then annealed in pressurized steam at a pressure of 35 psi and an annealing shrinkage of about 30%. The resulting annealed fibers had the following tensile properties:

TABLE 1A

| Fiber Sample | Spinbath Temp. C.° | Fiber Properties dpf | Tenacity g/den | Elongation % |
|---|---|---|---|---|
| 1 | 40 | 3.2 | 2.3 | 55.3 |
| 2 | 35 | 3.3 | 2.3 | 53.0 |
| 3 | 30 | 3.1 | 2.4 | 54.6 |
| 4 | 25 | 2.6 | 2.5 | 48.7 |

Samples of the fibers were tested on a Satec Flex Tester. The following (CTF) and (FFP) values were obtained for the fiber samples. For purposes of comparison samples of Orlon® 42 acrylic fiber made by DuPont Company and Acrilan® S-16 acrylic fiber made by Monsanto were obtained from a commercial source and also tested.

TABLE IB

| Fiber Sample | Dpf | AR | CTF | FFP Value |
|---|---|---|---|---|
| 1 | 3.0 | 1.8 | 291 | 0.66 |
| 2 | 2.9 | 1.8 | 337 | 0.73 |
| 3 | 2.9 | 1.8 | 467 | 1.05 |
| 4 | 3.0 | 1.8 | 259 | 0.55 |
| Orlon 42 (Control) | 3.1 | 2.3 | 90 | −0.89 |
| Acrilan S-16 (Control) | 2.7 | 1.8 | 48 | −1.41 |

The fiber samples of the invention had dye half-times or less than 10 minutes, whereas that for Orlon 42 was more than 50 minutes.

EXAMPLE 2

This example illustrates the effect of using different annealing pressures/shrinkages and different annealing methods on tensile properties and flex fatigue parameter values of fibers of this invention.

A dope was prepared and spun as described in Example I. The spinneret used had 1000 spinneret capillaries of a dogbone shape (aspect ratio: 2.5) with a cross-sectional area equivalent to a 3.25 mil (0.083 mm) diameter round hole. Two of the samples were conventionally annealed to 30 and 20% annealing shrinkage, respectively. The third sample was prepared by collecting the fibers bundle after the wet stretch, but before the drying step, and then drying/annealing the fiber bundle by subjecting it to dry air at 140° C. for 30. min.

TABLE 2A

| Fiber Sample | Spin Bath Temp. °C. | Annealing Pressure PSI (newtons/m$^2$ × 10$^5$) | Annealing Shrinkage % | dpf | Fiber Tenacity g/den | Elongation % |
|---|---|---|---|---|---|---|
| 1 | 40 | 34(2.34) | 30 | 3.3 | 2.4 | 50.9 |
| 2 | 40 | 21(1.45) | 20 | 2.6 | 2.7 | 33.9 |
| 3 | 40 | Air-dry | 20 | 2.7 | 2.5 | 29.7 |
| 4 | 30 | 33(2.28) | 30 | 3.4 | 2.2 | 53.7 |
| 5 | 30 | 21(1.45) | 20 | 2.6 | 2.9 | 36.0 |
| 6 | 30 | Air-dry | 20 | 3.4 | 3.1 | 28.2 |
| 7 | 20 | 31(2.14) | 30 | 3.9 | 2.7 | 46.5 |
| 8 | 20 | 21(1.45) | 20 | 3.0 | 2.9 | 35.4 |
| 9 | 20 | Air-dry | 20 | 2.6 | 3.2 | 28.1 |
| 10 | 10 | 32(2.21) | 30 | 2.8 | 2.7 | 46.8 |
| 11 | 10 | 21(1.45) | 20 | 2.6 | 3.1 | 33.4 |
| 12 | 10 | Air-dry | 20 | 3.4 | 3.3 | 27.7 |

The Satec test gave the following results:

TABLE 2B

| Sample | DPF | CTF | AR | FFP Value |
|---|---|---|---|---|
| 1 | 3.3 | 396 | 2.0 | 1.02 |
| 2 | 2.6 | 221 | 2.0 | −0.19 |
| 3 | 2.7 | 500 | 2.0 | 0.73 |
| 4 | 3.4 | 379 | 2.0 | 1.05 |
| 5 | 2.6 | 263 | 2.0 | −0.02 |
| 6 | 3.4 | 346 | 2.0 | 0.96 |
| 7 | 3.9 | 259 | 2.0 | 0.97 |
| 8 | 3.0 | 239 | 2.0 | 0.27 |
| 9 | 2.6 | 449 | 2.0 | 0.52 |
| 10 | 2.8 | 370 | 2.0 | 0.53 |
| 11 | 2.6 | 285 | 2.0 | 0.06 |
| 12 | 3.4 | 232 | 2.0 | 0.56 |

EXAMPLE 3

This example illustrates the results obtainable from a different polymer blend and through the use of atmospheric pressure super-heated steam (SHS) as a means of annealing.

A 25% polymer dope was prepared in DMF from a 98.2/1.8 blend of acrylic polymer I and a copolymer containing 68% acrylonitrile, 25.4% styrene, and 16.6% sodium styrene sulfonate. The dope was spun similar to Example I through a 1000 hole spinneret with dogbone shaped spinneret capillaries (aspect ratio: 3.5) of a cross-sectional area equivalent to a 3.79 mil diameter round hole. The fibers were spun with a 1.45 theoretical jet stretch in a spinbath of 78% DMF/22% water at 30° C. The resulting fibers had the following properties after pressurized steam annealing (34 psi, 28% annealing shrinkage):

TABLE 3A

| | |
|---|---|
| Dpf | 3.1 |
| Tenacity, gpd | 3.0 |
| Elongation, % | 39.2 |
| Aspect Ratio | 2.2 |
| Satec CTF | 411 |
| FFP Value | 0.71 |

A portion of the fiber bundle was collected wet after the wet stretch step, but before drying. The wet bundle was dried/annealed by treatment with atmospheric pressure superheated steam at 140° for 30 minutes. The resulting fibers (annealing shrinkage: 28%) had the following properties:

TABLE 3B

| | |
|---|---|
| Dpf | 3.1 |
| Tenacity, gpd | 3.0 |
| Elongation, % | 39.2 |
| Aspect Ratio | 2.2 |
| Satec CTF | 231 |
| FFP Value | 0.14 |

EXAMPLE 4

This example demonstrates the effect of using different solvent concentrations in the spinbath on the flex fatigue parameter values of fibers of this invention.

A 25% polymer dope was prepared in DMF from an acrylic copolymer (polymer III) containing 93.5% AN 6.2% VA and 0.3% SPME. The dope was spun similar to Example I with a jet stretch of 1.92 through a 1000 hole spinneret with capillaries shaped like a rectangle, capped at both ends with semicircles, having an aspect ratio of 3.0 and a cross-sectional area equivalent to that of a 4.7 mil (0.119 mm) diameter round hole. The fiber samples had the following properties:

TABLE 4A

| Sample | Spin-bath % DMF | Dpf | Tenacity g/den | Elonga-tion % | AR | CTF | FFP Value |
|---|---|---|---|---|---|---|---|
| 1 | 80 | 2.4 | 2.5 | 47.6 | 2.0 | 309 | −0.09 |
| 2 | 78 | 2.6 | 2.5 | 45.6 | 2.0 | 170 | −0.46 |
| 3 | 76 | 2.5 | 2.5 | 44.5 | 2.0 | 187 | −0.47 |

A fiber spun and annealed similarly to sample 2 had a knot tenacity of 2.5 g/den, a 98% retention of straight tenacity, and a knot elongation of 43.1%, a 95% retention.

In related experiments, 171 different fiber samples were made using substantially the same properties described above from different acrylic polymers spun through round as well as nonround capillaries. The following flex fatigue parameter values were obtained for various spin bath concentrations of DMF at a 30° C. spinbath temperature.

TABLE 4B

| Number of Samples | Spinbath % DMF | Average FFP |
|---|---|---|
| 61 | 82 | 0.40 |
| 22 | 80 | −0.07 |
| 57 | 78 | −0.13 |

TABLE 4B-continued

| Number of Samples | Spinbath % DMF | Average FFP |
|---|---|---|
| 31 | 74 | −0.45 |

EXAMPLE 5

This example illustrates the effect of using DMF versus that of using dimethyacetamide (DMAc) on the tensile properties and FFP values of wet spun acrylic fibers.

25% polymer dopes of acrylic polymer I were prepared in DMF (dope I) and DMAc (dope II). Dope I was spun into a 82% DMF spinbath substantially as described in Example 1 and dope II was spun similarly into an 82% DMAc spinbath. The fiber samples were collected as wet tow after the wet starch, then dried/annealed by heating them in hot air at 140° C. Results obtained are given in Table V.

TABLE 5

| Fiber Sample | Solvent | Dpf | Tenacity g/den | Elongation % | AR | dpf | CTF | FFP Value |
|---|---|---|---|---|---|---|---|---|
| 1 | DMF | 2.5 | 3.2 | 31.5 | 1.8 | 2.42 | 204 | −0.26 |
| 2 | DMAc | 2.5 | 2.2 | 55.4 | 1.8 | 2.50 | 75 | −1.17 |

EXAMPLE 6

This example demonstrates the advantage of using DMF at high concentrations in the spinbath. (60% is typical of conventional acrylic wet-spinning operations.)

A dope was prepared from a 50/50 blend of polymers I and II in DMF. Fiber samples were spun and annealed as in Example I. Spinbath temperature for samples 1–2: 35° C., 3–4: 25° C. Results obtained are given in Table 6.

TABLE 6

| Sample | Spinbath % DMF | °C. | Dpf | Tenacity g/den | Elongation % | AR | CTF | FFP Value |
|---|---|---|---|---|---|---|---|---|
| Control | 60 | 35 | 3.1 | 2.3 | 38.4 | 1.8 | 15 | −2.40 |
| Invention | 78 | 35 | 2.8 | 2.3 | 53.0 | 1.8 | 183 | −0.01 |
| Control | 60 | 25 | 3.1 | 2.3 | 38.9 | 1.8 | 26 | −1.85 |
| Invention | 78 | 25 | 3.0 | 2.5 | 48.7 | 1.8 | 141 | 0.55 |

The results show that fibers of this invention were not obtained when a conventional concentration of DMF was used in the spinbath.

EXAMPLE 7

This example illustrates that a fiber sample spun into high concentrations of DMF in the spinbath has high flex fatigue/abrasion properties even without being annealed.

A 25% polymer dope of acrylic polymer I was spun through a 1000 hole spinneret with spinneret capillaries as described in example IV into a 80% DMF spinbath at 25° C.; the dope contained 2% water. The resulting filament bundle was subjected to 1.73× jet stretch, a 6× wet stretch and a subsequent relaxation of 13% in boiling water before being dried on rolls in a conventional manner. The filament bundle was crimped in a stuffer box crimper. The crimped fibers had the following properties:

TABLE 7A

| | |
|---|---|
| Dpf | 2.2 |
| Tenacity | 3.4 |
| Elongation, % | 23.6 |

The crimped fiber had the following Satec properties:

TABLE 7B

| | |
|---|---|
| AR | 1.8 |
| Dpf | 1.96 |
| Satec CTF | 1076 |
| FFP | 0.78 |

A dry-spun fiber, Orlon 42, had the following Satec properties under identical testing conditions.

TABLE 7C

| | |
|---|---|
| AR | 2.3 |
| Dpf | 3.0 |
| Satec CTF | 92 |
| FFP | −0.96 |

EXAMPLE 8

This example demonstrates that fibers with increased FFP Values obtainable through the spinning process of this invention will have increased utility such as increased wear life of crew socks made from such fibers. In this test fibers of widely different cross-sections were used:

TABLE 8A

| Fiber Type | X-Section | Aspect Ratio (AR) |
|---|---|---|
| Acrilan S-16 | Kidney Bean | 1.8 |
| Orlon 42 | Dogbone | 2.3 |
| Invention | Round | 1.0 |

In a scaled-up spinning trial, a 25% polymer dope obtained by dissolution of polymer III in DMF was spun through a 32,000 hole spinneret into a spinbath containing 73.5 to 74% DMF at 35° C. The spinneret capillaries were round with a 5 mil (0.127 mm) diameter. The extruded fiber bundle was subjected to a 2.3× jet stretch and a 6× wet stretch, dried on rolls at 150° C., crimped, and then annealed to a 28% annealing shrinkage. Single fiber properties were as follows:

TABLE 8B

| Sample | dpf | Tenacity g/den | Elongation % | Knot Tenacity g/den | Knot Elongation % |
|---|---|---|---|---|---|
| Invention | 2.7 | 2.4 | 51.8 | 2.2 | 54.2 |

The tow obtained was converted to spun yarn by use of the Seydel stretch breaking process followed by conventional yarn spinning. The yarn was converted to crew socks which were subjected to a wear test using a 180 member test panel; socks made from Orlon 42 and Acrilan S-16 yarns were included in the wear test as controls. The following results were obtained on the annealed filaments before conversion to spun yarn:

| Sample | Dpf | CTF | AR | FFP Value |
|---|---|---|---|---|
| Acrilan S-16 | 2.5 | 54 | 1.8 | −1.50 |
| Orlon 42 | 3.0 | 109 | 2.3 | −0.79 |
| Invention | 2.5 | 127 | 1.0 | 0.42 |

The invention sample and Orlon 42 had dye half-times of 9.3 and 39.1 minutes, respectively.

In the wear test 50% of the socks of each sample group were worn out after the following number of 12 hr wear days:

TABLE 8D

| Sample | Wear Days |
|---|---|
| Acrilan S-16 | 21 |
| Orlon 42 | 23 |
| Invention | 37 |

EXAMPLE 9

This example shows the effect of using a high concentration of dimethylacetamide (DMAc) instead of DMF in the coagulation bath on the processability and tensile properties of the resulting tow.

Two tows consisting of 32,000 fibers were prepared as described in Example 1, except one tow (Control) was prepared utilizing a coagulation bath consisting of 78% DMAc/22% $H_2O$ and the other tow (Invention) was prepared utilizing a coagulation bath consisting of 75% DMF/25% $H_2O$. A spinnerette having 32,000 5 mil (0.127 mm) rounded end slot jets was used to spin each tow.

The spinning performance of each tow was observed. The tow coagulated using DMF as the solvent was substantially free from married fibers, whereas the tow coagulated in DMAc contained numerous married fibers.

Twenty fiber samples were taken from each tow and tested to determine its physical properties. The results of the testing are given below and represent the average results obtained for each one of the twenty samples.

TABLE 9A

| Tow | Solvent | Tenacity Break (gpd) | Initial Modulus (gpd) | Elongation % |
|---|---|---|---|---|
| Invention | DMF | 2.18 | 33.63 | 50.59 |
| Control | DMAc | 2.04 | 35.88 | 46.55 |

The use of DMF in the spinbath provided a tow having slightly better physical properties than the corresponding tow prepared using DMAc in the spinbath.

What is claimed is:

1. A wet-spun tow consisting of at least 1000 filaments consisting of a copolymer of acrylonitrile and one or more vinyl monomers copolymerizable therewith, wherein from 85% to 98% by weight of its units are acrylonitrile units of the formula $$-CH_2-\underset{\underset{CN}{|}}{CH}-,$$

said filaments being characterized in having a mercury density greater than 1.0 grams/cc, an average flex fatigue parameter of at least −0.11, a tenacity of at least 2.0 gpd, knot strengths of at least 90% of the tenacity and an elongation in the range of 35% to 60% and in containing from 0.001 to 1.0% by weight of dimethylformamide.

2. The tow as defined in claim 1 wherein the tow contains at least 20,000 filaments.

3. Staple fibers made from the tow of claim 1.

4. The tow of claim 1 further characterized in that the filaments each have a denier in the range of 1.5 to 3.5.

* * * * *